US006883216B2

(12) United States Patent
Gilbert et al.

(10) Patent No.: US 6,883,216 B2
(45) Date of Patent: Apr. 26, 2005

(54) FASTENER INSTALLATION TOOL INCLUDING FASTENER-PARTS COLLECTION MEANS

(75) Inventors: Terence Gilbert, Welwyn Garden (GB); Aiden Robert Dear, Nr. Hitchin (GB)

(73) Assignee: Textron Fastening Systems Limited (GB)

( * ) Notice: Subject to any disclaimer, the term of this patent is extended or adjusted under 35 U.S.C. 154(b) by 0 days.

(21) Appl. No.: 10/468,683

(22) PCT Filed: Jan. 21, 2002

(86) PCT No.: PCT/GB02/00227

§ 371 (c)(1),
(2), (4) Date: Jan. 13, 2002

(87) PCT Pub. No.: WO02/066180

PCT Pub. Date: Aug. 29, 2002

(65) Prior Publication Data

US 2004/0112178 A1 Jun. 17, 2004

(30) Foreign Application Priority Data

Feb. 21, 2001 (GB) ..... 0104218

(51) Int. Cl.[7] ..... B21J 15/20

(52) U.S. Cl. ..... 29/243.523; 29/243.525; 29/453.17

(58) Field of Search ..... 29/243.521, 243.522, 29/243.523, 243.524, 243.525; 72/453.17, 453.19

(56) References Cited

U.S. PATENT DOCUMENTS

| | | | | | |
|---|---|---|---|---|---|
| 4,137,747 | A | | 2/1979 | Clarke et al. | |
| 4,887,450 | A | * | 12/1989 | Gast et al. | 29/243.523 |
| 4,888,974 | A | | 12/1989 | Mandell | |
| 5,086,551 | A | * | 2/1992 | Shamaly et al. | 29/243.523 |
| 5,490,311 | A | * | 2/1996 | Rosier | 29/243.523 |
| 5,694,671 | A | * | 12/1997 | Frearson et al. | 29/243.525 |
| 6,163,945 | A | * | 12/2000 | Amano et al. | 29/243.523 |
| 6,425,170 | B1 | * | 7/2002 | Zirps et al. | 29/243.525 |

FOREIGN PATENT DOCUMENTS

| | | |
|---|---|---|
| DE | 8913355 | 12/1989 |
| DE | 9411731 | 9/1994 |
| EP | 1038608 | 9/2000 |
| GB | 2215253 | 9/1989 |
| WO | WO8701630 | 3/1987 |
| WO | WO9638244 | 12/1996 |
| WO | WO9638245 | 12/1996 |

* cited by examiner

*Primary Examiner*—David Jones
(74) *Attorney, Agent, or Firm*—Trexler, Bushnell, Giangiorgi & Blackstone & Marr, Ltd

(57) ABSTRACT

A fastener installation tool for installing fasteners of the type in which a part of the fastener is broken off during installation. The tool is provided with a collection means for collecting broken-off fastener parts during operation of the tool, the collection means being removably connectable to the tool. The tool includes retaining means for retaining the collection means against removal from the tool and the retaining means is air-pressure actuated into the retaining condition. The tool may include resiliently urged shutter means which are held open when the collection means is attached.

14 Claims, 5 Drawing Sheets

FASTENER INSTALLATION TOOL INCLUDING FASTENER-PARTS COLLECTION MEANS

RELATED/PRIORITY APPLICATION

This application is a National Phase filing regarding International Application No. PCT/GB02/00227, and claims priority with respect to UK Application No. 0104218.3, filed Feb. 21, 2001.

The invention relates to a fastener installation tool provided with collection means for collecting broken-off fastener parts, i.e. that part of each fastener which is broken off during the installation process.

Such fastener installation tools have been well known for many years. A typical example of such a tool is described in our earlier specification WO 96/38245, to which the reader is referred for further information about the construction, operation and practical requirements of such tools.

One such practical requirement is that the collection means is secured to the tool during its operation, and is readily removable from the tool (to empty out the collected parts) and then readily re-securable to the tool (to enable continued operation thereof) without undue delay.

Another practical requirement is that, whilst the collection means is removed from the tool, a broken-off fastener part cannot be ejected from the tool (for safety reasons).

The present invention aims to provide a tool which meets each of these requirements.

The invention provides, in one of its aspects, a fastener installation tool for installing fasteners of the type in which a part of the fastener is broken off during installation, which fastener installation tool is provided with collection means for collecting broken-off fastener parts during operation of the tool, the collection means being removablye connected to the tool, including retaining means for retaining the collection means against removal from the tool, the retaining means being air-pressure actuated into the a retaining condition.

The invention provides, in another of its aspects, fastener installation tool for installing fasteners in which a part of the fastener is broken off during the installation process, which fastener installation tool is provided with collection means for collecting broken-off fastener parts during operation of the tool, the collection means being removably connected to the tool: which tool is provided with resiliently urging shutter-means which, when the collection means is connected to the tool, is held open against the resilient urging shutter-means to allow the passage of broken-off fastener parts from the tool into the collection means, and which, when the collection means is disconnected from the tool, closes under the action of the resilient urging shutter-means to prevent ejection of broken-off fastener parts from the tool, in which when the collection means is connected to the tool, the shutter is held open by the action of air pressure, disconnection of the collection means removing the air pressure and allowing the shutter to close under the action of the resilient urging shutter-means.

A specific embodiment of the invention will now be described by way of example and with reference to the accompanying drawings in which.

Figure 1:
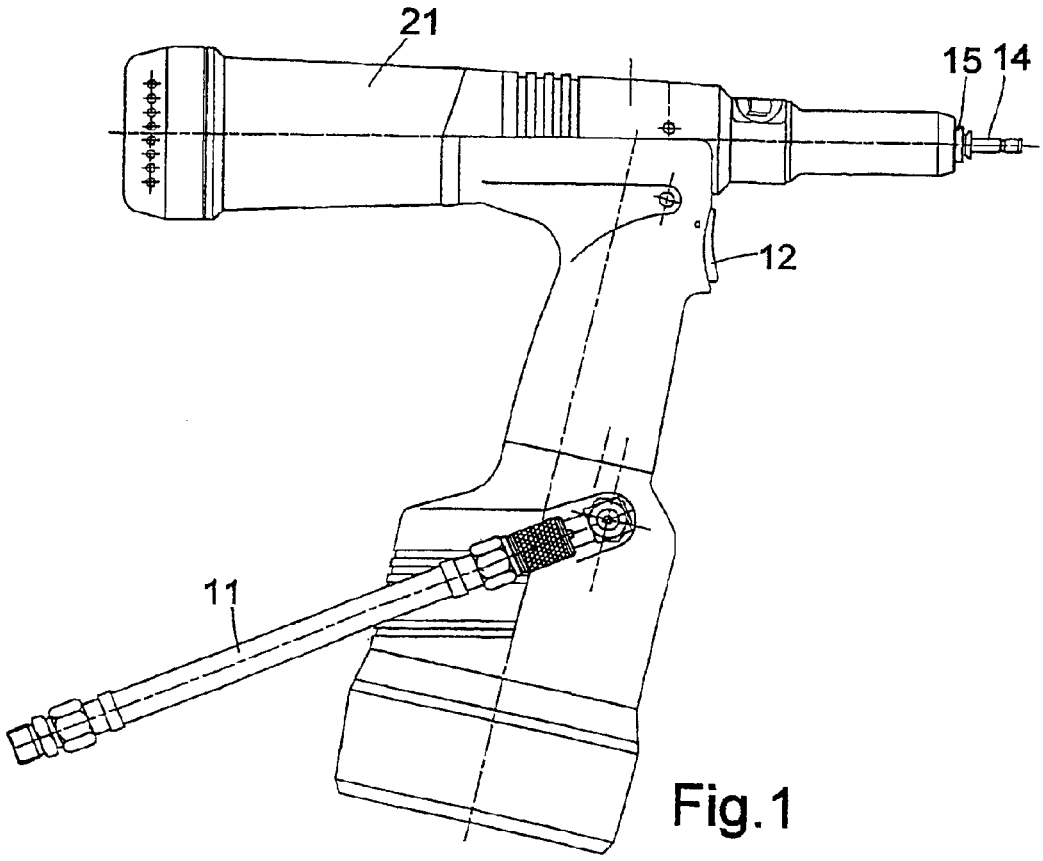
FIG. 1 is an exterior elevation of a blind-riveting tool.
Figure 2A:
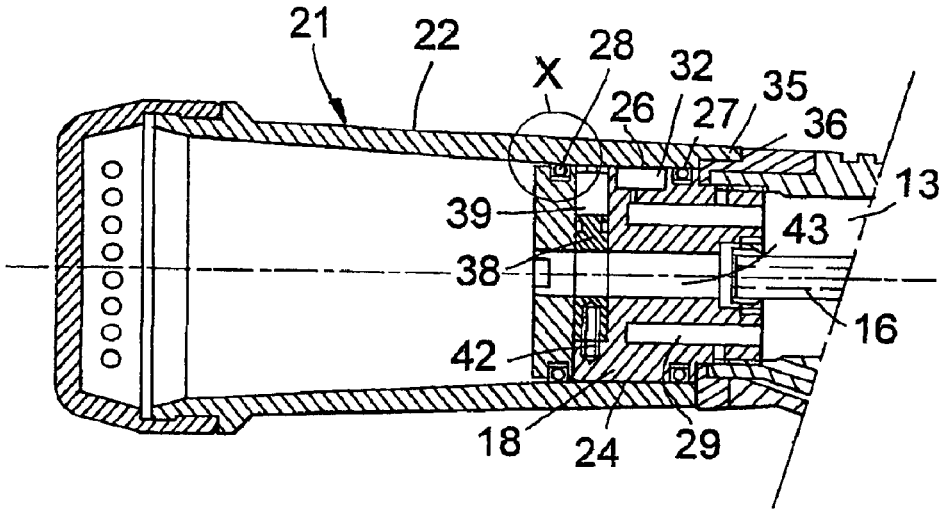
FIGS. 2A and 2B are respectively an axial section and a cross section, through the collection means and the adjacent part of the tool in the connected condition.
Figure 2B:
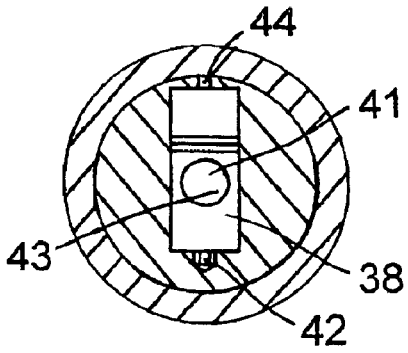
Figure 3A:
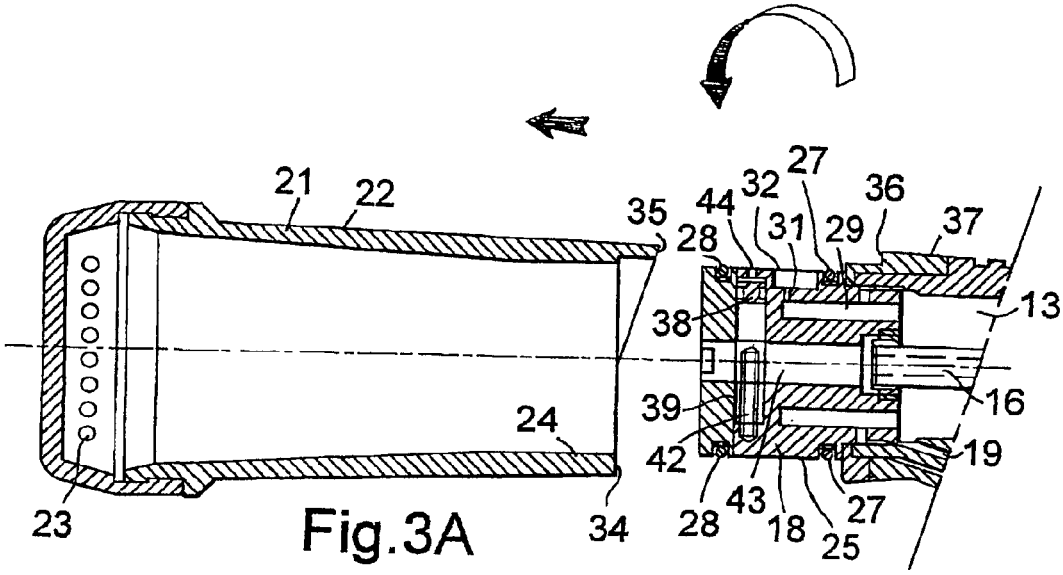
Figure 3B:
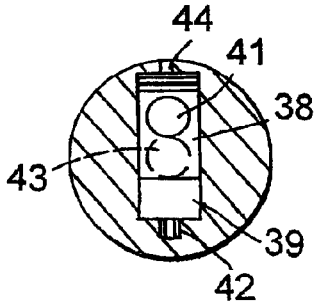
Figure 4A:
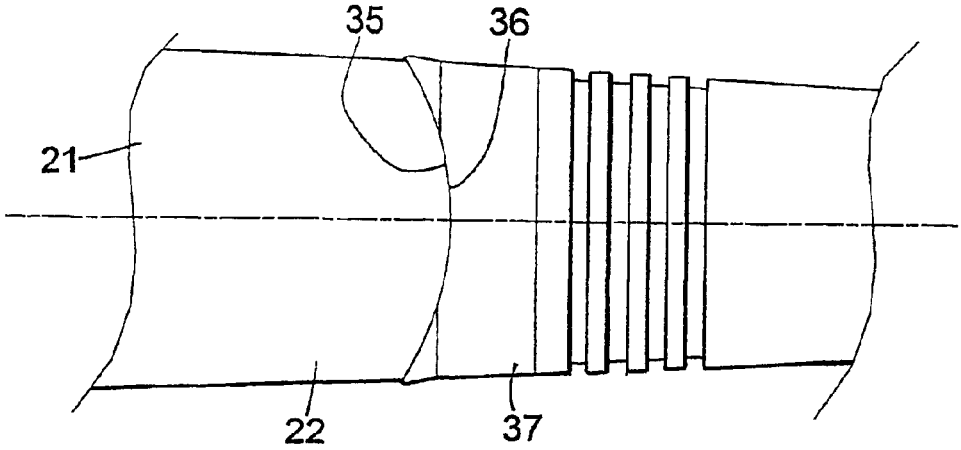
Figure 4B:
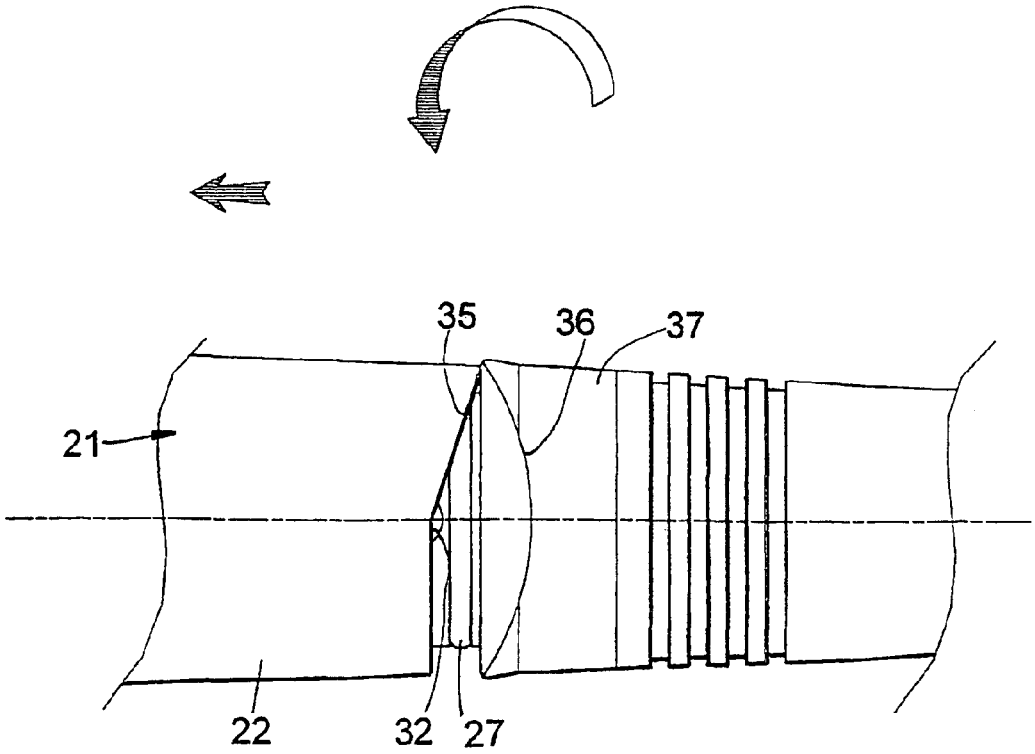
Figure 5A:
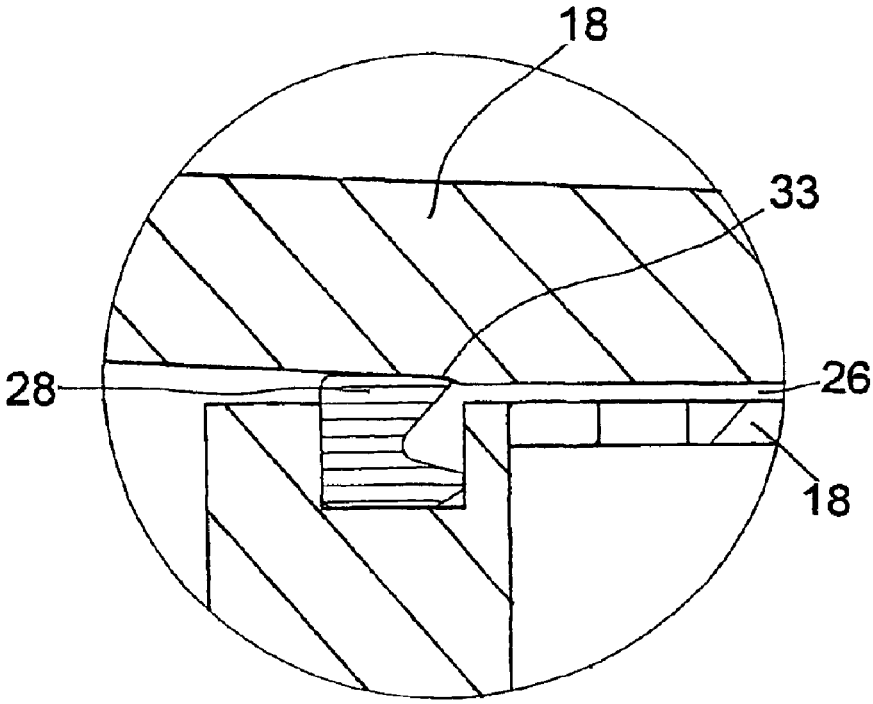
Figure 5B:
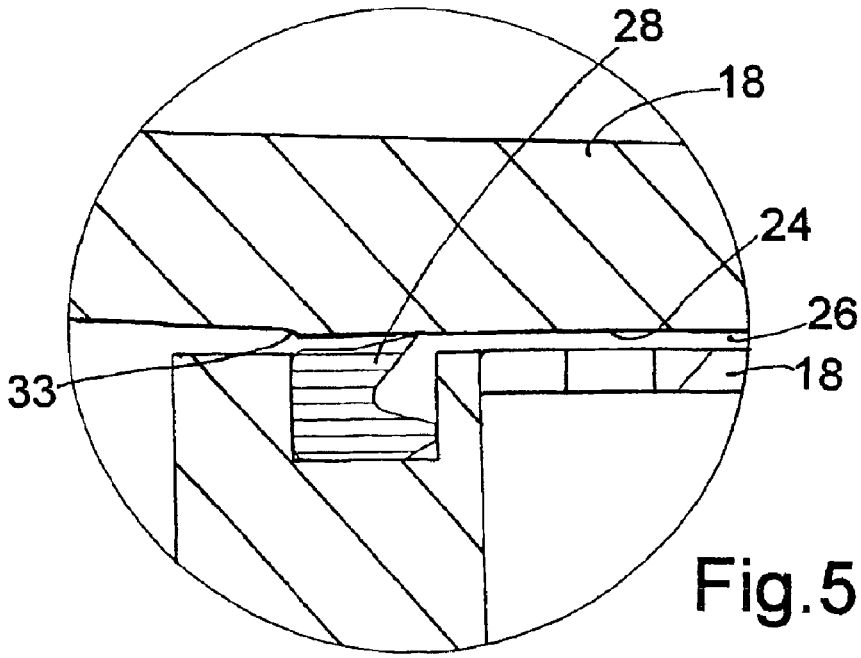

FIGS. 3A and 3B correspond to FIGS. 2A and 2B respectively, and show the disconnected condition;

FIGS. 4A and 4B are exterior top views of the adjacent parts of the collection means and tool, illustrating the cam arrangement for assisting initial displacement; and FIGS. 5A and 5B are enlarged sections of the area marked X in FIG. 2A, illustrating the detent action of one of the flexible resilient members.

The hand-held blind riveting tool is substantially identical to that described in WO 96/38345, to which the reader is referred for a description of the construction and operation of the tool. The present tool includes a pneumatic/hydraulic intensifier, fed by compressed air through a hose 11. When an external trigger 12 is pressed, the intensifier is actuated to drive a head piston along a bore 13 (FIGS. 2A and 3A) to cause a jaw-assembly to grip and pull the pin-tail of a blind rivet 14 which has been inserted in the nosetip 15 of the tool. The body of the blind rivet deforms, and eventually the pin of the rivet breaks and the jaws retract with the broken off pin-tail. The jaws release the pin-tail which is ejected rearwardly along a tube 16 which extends along the centre of bore 13. The tube 16 leads into a bore 43 through a connector block 18 which is secured on the rear end of the bore 13.

In order to return the head piston and jaws forwardly when the trigger 12 is released, air under pressure is fed all the time along a bore 19 to the bore 13 behind the piston. This air pressure feed is also used for other purposes, as will be described below.

Means for collecting broken off pin-tails is provided by what is known as a bottle 21. This is substantially cyclindrical, but with a slightly tapering exterior surface 22. The rear end of the bottle is provided with vent holes 23. The major part of the interior of the surface of the bottle tapers slightly, but the front part 24 is cyclindrical. This mates with the cylindrical exterior face 25 of the connector block 18, there being a narrow annular gap 26 between the faces 24 and 25 (FIGS. 2A, 5A and 5B).

The connector block 18 carries two flexible resilient sealing members 27 and 28. The forward most one 27 is an O-ring seal, and the rearward most one 28 is a lip-seal. Both seals protrude sufficiently above the surface 25 of the connector block 18 (see FIG. 3A) that when the bottle is in the connected or secured position shown in FIG. 2A, in which the front end 24 of the bottle 21 is fully forward over the connector block 18, both seals contact the inner surface of the bottle (as described in detail below). Air under pressure from feed bore 19 is fed, by means of the rear part of the bore 13, an annular gap 29 in the front of connector block 18, a radial bore 31 and a silencer chamber 32, to the annular gap 26. The chamber 32 is positioned between the seals 27 and 28, so that air pressure is applied to both seals. This air pressure causes both seals to deform slightly, so as to expand radially to produce enhanced frictional contact between the seals and the bottle 21. This substantially increases the force necessary to remove the bottle from the connector block, thus effectively securing the bottle to the tool.

The forward seal 27 is an O-ring seal (i.e. of circular cross-section), but the rearward seal 28 is a lip-seal, and its action is illustrated in enlarged sections in FIGS. 5A and 5B. As shown in these Figures, the rear end of the circular section 24 of the bottle interior joins the slightly tapering section behind it by means of a more steeply sloping tapered section 33, in which the lip-seal 28 can engage when the bottle is in the secured condition (as shown in FIG. 2A). This engagement is shown in FIG. 5A, in which the lip-seal is radially expanded by means of the air pressure in annular gap 26. This effectively provides a resilient detent engagement between the bottle and the connector block.

In order to release this enhanced frictional engagement between the bottle and the connector block, it is necessary to axially withdraw the bottle from the adapter until the front end 34 clears the forward seal 27. This needs considerable force, even after the initial disengagement of the detent lip-seal from the taper section 33. It is doubtful whether a tool operator could apply sufficient force, by hand, by grasping and axially pulling at the bottle. Even if he or she could do so, the sudden reduction in restraining force, when the front end 34 of the bottle clears seal 27, would very likely result in the sudden acceleration of the bottle and the scattering of its contents out of its open front-end, which would be highly undesirable.

Accordingly, means for assisting in the initial displacement of the bottle is provided in the form of a cam arrangement. As illustrated in FIGS. 2A, 3A, 4A and 4B, the front end 34 of the bottle is formed with a projecting arcuate cam 35 which extends around half the circumference of the bottle and is of increased internal radius, so that it mates with a corresponding arcuate cam 36 provided on the connector block retaining ring 37. FIGS. 2A and 4A show the bottle in the fully engaged position, with the two cams 35 and 36 aligned. To initially disengage the bottle, the operator grips the exterior surface 22 of the bottle 21 and rotates the bottle about its axis. This drives the cam 35 to force the bottle rearwards with considerable mechanical advantage, until the front end 34 of the bottle clears seal 27 (FIG. 4B shows the bottle rotated through 90°, driving the front end 34 well beyond the seal 27). The deforming air pressure on the seals having been vented, completion of removal of the bottle is easily achieved. After the bottle has been emptied, its replacement on the connector block is also relatively easily achieved, since the operator can more easily apply manual compressive force to the end of the bottle to force it forwards over the radially enlarged seals 27 and 28 after the bottle front end 34 has again met and sealed against forward seal 27.

Another feature of the invention is also illustrated in FIGS. 2A and 3A and more particularly in FIGS. 2B and 3B.

It is known to provide this type of blind-riveting tool with a safety shutter at the rear end of the tool body, which is opened when the pin-tail collector bottle is connected to the tool, but which closes automatically, under resilient urging, when the bottle is removed from the tool. This is a safety device, to prevent ejection of a pin-tail if the tool is operated when the bottle is not connected (since the head-piston and jaw-assembly are automatically returned by air pressure when the tool trigger is released after a riveting operation, if the collector bottle is then removed and the return air vented, one further fastener can be installed before the head piston is not returned forwards again). It is known (e.g. in a tool under the name MASTERFIX, and in certain tools under the name HONSEL) to close the safety shutter mechanically by contact of the bottle, when in the connected position, with a lever or button which the bottle displaces against a spring from the shutter-closed position to the shutter-open position. However it has been found that it is possible to override such mechanically operated safety devices by holding the lever or button in the shutter-open position e.g. by finger-pressure, by a wedge, or by the application of adhesive tape. In order to overcome this, in the tool of this example the shutter is held closed by air pressure which is vented when the bottle is removed. Thus the shutter 38 is provided by a rectangular-section plunger moving in a rectangular-section transverse bore 39 in the connector block 18. The shutter 38 has a circular aperture 41, and is urged by a coil spring 42 into a position in which the aperture does not correspond with the pin-tail passage bore 43 axially through the adapter, i.e. the closed position. The shutter is held in its open position, in which the aperture 41 is aligned with the passage 43, by air pressure applied at the end of the bore 39 remote from the spring 42. This is achieved by the means of a short radial bore 44 which connects the end of the bore 39 to the exterior surface of the connector block and thus to the annular gap 26 to which air pressure is fed as previously described. When the bottle is in the fully connected and retained position (FIG. 2A), the air pressure in the annular gap 26 holds the shutter open (FIG. 2B). As soon as the bottle is axially withdrawn sufficiently for its front end 34 to clear the front seal 27, the air pressure is vented and the shutter closes (FIG. 3B). The only way in which the shutter could be held closed while the bottle is not connected would be to apply and maintain sufficient air pressure to the radial bore 44, which would in practice be very difficult.

An advantage of the tool of the foregoing example is that pin-tail ejection is prevented as soon as the bottle 22 is unlocked from the tool when the seal 27 is released.

The invention is not restricted to the details of the foregoing example. For instance, although it is convenient to use the same air pressure application and automatic venting arrangement to actuate both the bottle retention feature, and the shutter closure feature, either feature could be used without the other.

The lip-seal 28 could be substituted by, for example, an O-ring seal similar to the one 27, but with lowered bottle retention force.

The shutter closing spring 42 could be substituted, for example, by air pressure.

What is claimed is:

1. A fastener installation tool for installing fasteners of the type in which a part of the fastener is broken off during installation, which fastener installation tool is provided with collection means for collecting broken-off fastener parts during operation of the tool, the collection means being removable connectable to the tool;

including retaining means for retaining the collection means against removal from the tool, the retaining means being air-pressure actuated into a retaining condition.

2. A tool as claimed in claim 1, in which the retaining means comprises at least one flexible resilient member which is urged into the retaining condition by actuating air pressure.

3. A tool as claimed in claim 2, in which the or each flexible resilient member extends around a circle's circumference.

4. A tool as claimed in claim 3, in which at least one of the resilient members provides a retaining function by friction.

5. A tool as claimed in claim 4, in which at least one member is an O-ring seal.

6. A tool as claimed in claim 3, in which one of the resilient members provides a retaining function by acting as a detent.

7. A tool as claimed in claim 6, in which the member is a lip-seal.

8. A tool as claimed in claim 2, in which there are two flexible resilient members, the actuating air pressure being applied between them.

9. A tool as claimed in claim 8, including means for assisting the initial displacement of the collecting means from the tool so that one of the flexible members loses its retaining condition and allows the air pressure to vent, thereby allowing the other flexible member to lose its retaining condition.

10. A tool as claimed in claim 9, in which the means for assisting initial displacement comprises a cam arrangement.

11. A tool as claimed in claim 10, in which rotation of the collection means relative to the tool operates the cam arrangement to displace the collecting means as aforesaid.

12. A fastener installation tool for installing fasteners in which a part of the fastener is broken off during the installation process, which fastener installation tool is provided with collection means for collecting broken-off fastener parts during operation of the tool, the collection means being removably connected to the tool; which tool is provided with resiliently urging shutter-means which, when the collection means is connected to the tool, is held open against the resilient urging shutter-means to allow the passage of broken-off fastener parts from the tool into the collection means, and which, when the collection means is disconnected from the tool, closes under the action of the resilient urging shutter-means to prevent ejection of broken-off fastener parts from the tool;

in which, when the collection means is connected to the tool, the shutter is held open by the action of air pressure, disconnection of the collection means removing the air pressure and allowing the shutter to close under the action of the resilient urging shutter-means.

13. A tool as claimed in claim 12, in which removal of the air pressure is achieved by venting.

14. A tool as claimed in claim 12 including retaining means for retaining the collection means against removal from the tool, the retaining means being air-pressure actuated into the retaining condition and in which the same air pressure is used both to urge the retaining means into its retaining condition, and to hold open the shutter means.

* * * * *